US006701690B2

(12) United States Patent
Deschenes

(10) Patent No.: US 6,701,690 B2
(45) Date of Patent: Mar. 9, 2004

(54) I-SHAPED WOODEN BEAM

(76) Inventor: Guildo Deschenes, 207 route 295, Ville Degelis, Québec (CA), G5T 1R1

( * ) Notice: Subject to any disclaimer, the term of this patent is extended or adjusted under 35 U.S.C. 154(b) by 0 days.

(21) Appl. No.: 10/194,279

(22) Filed: Jul. 15, 2002

(65) Prior Publication Data

US 2003/0014938 A1 Jan. 23, 2003

(30) Foreign Application Priority Data

Jul. 17, 2001 (CA) ..... 2353202

(51) Int. Cl.[7] ..... E04C 3/30
(52) U.S. Cl. ..... 52/729.4; 52/730.7
(58) Field of Search ..... 52/729.4, 730.1, 52/730.7, 745.19

(56) References Cited

U.S. PATENT DOCUMENTS

| | | | | | |
|---|---|---|---|---|---|
| 4,195,462 | A | * | 4/1980 | Keller et al. | 52/690 |
| 4,947,612 | A | * | 8/1990 | Taylor et al. | 52/693 |
| 4,967,534 | A | * | 11/1990 | Lines | 52/729 |
| 5,653,080 | A | * | 8/1997 | Bergeron | 52/729.4 |

FOREIGN PATENT DOCUMENTS

| | | |
|---|---|---|
| CA | 464922 | 5/1950 |
| CA | 691335 | 1/1964 |
| CA | 701065 | 1/1965 |
| CA | 730348 | 3/1966 |
| CA | 1065116 | 10/1979 |
| CA | 1099473 | 4/1981 |
| CA | 1105228 | 7/1981 |
| CA | 1130078 | 8/1982 |
| CA | 1182266 | 2/1985 |
| CA | 1184013 | 3/1985 |
| CA | 1196169 | 11/1985 |
| CA | 2004067 | 11/1989 |
| CA | 1279972 | 2/1991 |
| CA | 1286081 | 7/1991 |
| CA | 1328340 | 4/1994 |
| CA | 2070905 | 5/1994 |
| CA | 2133776 | 2/1997 |
| CA | 2239321 | 2/1998 |
| CA | 2260694 | 2/1999 |
| CA | 2261526 | 2/1999 |
| CA | 2199903 | 2/2000 |
| CA | 2316668 | 8/2000 |
| CA | 2328338 | 12/2000 |

* cited by examiner

*Primary Examiner*—Carl D. Friedman
*Assistant Examiner*—Naoko Slack
(74) *Attorney, Agent, or Firm*—Robic

(57) ABSTRACT

The I-shaped wooden beam has two elongated chords extending in parallel relationship and blocks, struts or a web extending between the chords. Each of the chords is made of two pieces of wood having adjacent surfaces that are in contact and extend in parallel relationship with respect to the blocks, struts or web over the corresponding opposite end thereof. The two pieces of wood also have tongues and grooves positioned close to their adjacent surfaces and sized to match with opposite tongues and grooves made on the corresponding opposite end of the blocks, struts or web. These two pieces of wood are rigidly connected to each other and to blocks, struts or web so as to form an unitary structure of I-shape.

15 Claims, 5 Drawing Sheets

I-SHAPED WOODEN BEAM

BACKGROUND OF THE INVENTION a) Field of the Invention

The present invention relates to an I-shaped wooden beam of improved structure. More specifically, it relates to a wooden beam comprising two elongated chords connected to opposite ends of at least one joining member, wherein each of the chords is made of two pieces of wood that are rigidly connected to each other and to the joining member(s) so as to form a unitary structure of I-shape.

The invention also relates to a process for manufacturing a wooden beam having such an improved structure.

In the following description and claims, the word "beams" must be interpreted as encompassing any kind of construction elements which may also be called "joists", "girders", "rafters", "studwood", "joined studwood", "laminated studwood", "framing timbers", "trusses" and "roof trusses" in the construction industry.

b) Brief Description of the Prior Art

Wooden beams of I shaped structure are well known and commonly used in the construction industry. They basically comprise two elongated chords (sometimes also called "flanges") that extend in parallel relationship, and at least one joining member extending between the chords. In practice, the at least one joining member may consist of a web extending over the full length of the beam (see, for example, U.S. Pat. Nos. 4,456,497; 4,715,162 and 5,323,584). Alternatively, it may consist of a plurality of struts that extend perpendicularly with respect to the chords or, preferably, at an angle with respect to the chords and with respect to each other (see, for examples, U.S. Pat. Nos. 3,452,502 and 5,664,393). In all cases, the web or struts have opposite ends that are rigidly connected to the chords to form the requested, I-shaped unitary structure.

If such I-shaped wooden beams are of a great interest and presently used on a large scale in the construction industry, they nevertheless are known present two basic drawbacks.

The first one is their manufacturing costs that may be high when, as is of common practice, each of the chords is made of a "natural", one-piece lumber having a 2"×3" or 2"×4" cross-section. Such a one-piece lumber must indeed be cut in a tree log and processed to be connected to the joining member(s). It must thereafter be connected to the joining member(s). All these steps are expensive because of the cost of "natural" wood and the time required to cut logs into lumbers of suitable size and to subsequently connect of such lumbers to the joining member(s) to obtain the requested I-shaped beam.

The second drawback of the I-shaped wooden beams presently in use is their stability over the time. Indeed, the lumbers forming the chords are made of material wood that is known to absorb moisture and be subject to warping.

To tentatively get rid of these two drawbacks, it has already been suggested to manufacture I-shaped wooden beams with chords and optionally joining member(s) made of "engineered" lumbers, like those known as "laminated strand lumbers", "laminated veneer lumbers", "parallel strand lumbers" and "glued laminated timbers" (see, for further information on such engineered lumbers, columns 1 to 3 of U.S. Pat. No. 6,012,262). The advantages of such beams are that (1) their chords need not be cut from a tree log and are thus much less expensive to manufacture and (2) since the chords are made of different laminated components, they are less subject to deformation over the time, especially in the presence of moisture. In connection with point (1), it can be appreciated that engineered lumbers are quite easy to manufacture and the availability of such lumbers of any dimension is therefore much higher than the availability of natural lumbers of the same dimension.

As examples of I-shaped wooden beams with chords made of engineered lumbers, reference can be made to the above U.S. Pat. No. 6,012,262 and its Canadian counterpart No. 2,199,903. Reference can also be made Canadian patent Nos. 701,065; 1,065,116; 1,182,266; 1,196,169; 1,279,972 and 2,133,776.

OBJECT AND SUMMARY OF THE INVENTION

An object of the present invention is to provide I-shaped wooden beam wherein each of chords is made of two pieces of natural wood that are rigidly connected to each other and to the joining member(s).

More specifically, each of the chords is made of two pieces of wood having adjacent surfaces that are in contact and extend in parallel relationship with respect to the at least one joining member over the corresponding opposite end thereof. The two pieces of wood also have tongues and grooves positioned close to their adjacent surfaces and sized to match with opposite tongues and grooves made on the corresponding opposite end of the at least one joining member. In use, the pieces of wood are rigidly connected to each other and to the at least one joining member preferably by gluing, so as to form the requested unitary structure of I-shape.

The I-shaped wooden beam according to the invention is of improved structure as compared to the existing beams whose chords are each made of a one-piece lumber. Indeed, the beam according to the invention is much less subject to wasping since each of its chords is made of two pieces that are connected to each other preferably by gluing, and thus <<behaves>> like a laminate.

The beam according to the invention is also easier to manufacture since the pieces forming chords are half of the size of the conventional chords and thus easier to cut.

Furthermore, the beam according to the invention is easier to assemble since the pieces forming its chords are shaped to <<fit >> onto the ends of the joining member(s), thereby making their connection much easier to carry out.

Moreover, the structural strength, rigidity and resistance of the beam according to the invention are excellent since the connection of the opposite ends of the joining member(s) to the chords is achieved by means of tongues and grooves. Therefore, even if some of the glue or other means used to connect the pieces and joining member(s) together is missing or removed accidentally over some of the length of the beam, the connection will nevertheless remain strong, efficient and safe.

When use is made of glue for assembling the pieces of wood and joining member(s) together, the wooden beam according to the invention is preferably manufactured by:

(a) positioning the pieces of wood that extend on a same side of both chords, in a shaped apart, parallel relationship onto a flat surface;

(b) applying a layer of glue onto the tongues, grooves and surfaces of the pieces positioned in step (a);

(c) positioning and pressing the at least one joining member onto the pieces onto which the glue was applied in step (b) to cause the tongues and grooves made on one side of the opposite ends of said at least one joining member to snap and fit into the tongues and grooves of the spaced apart pieces;

(d) applying a layer of glue onto the other tongues and grooves made on the other sides of the at least one joining member; and (e) positioning and pressing the other pieces of wood of the chords to cause their tongues and grooves to snap and fit into the other grooves and tongues of the at least one joining member, and the surfaces of said other pieces to come into contact and be glued to the adjacent surfaces of the pieces positioned in step (a).

This process is another important object of the invention which is claimed per se hereinafter.

The invention and its numerous advantages will be better understood upon reading the following non-restrictive description of two preferred embodiments thereof made with reference to the accompanying drawings.

DETAILED DESCRIPTION OF THE INVENTION

Figure 1:
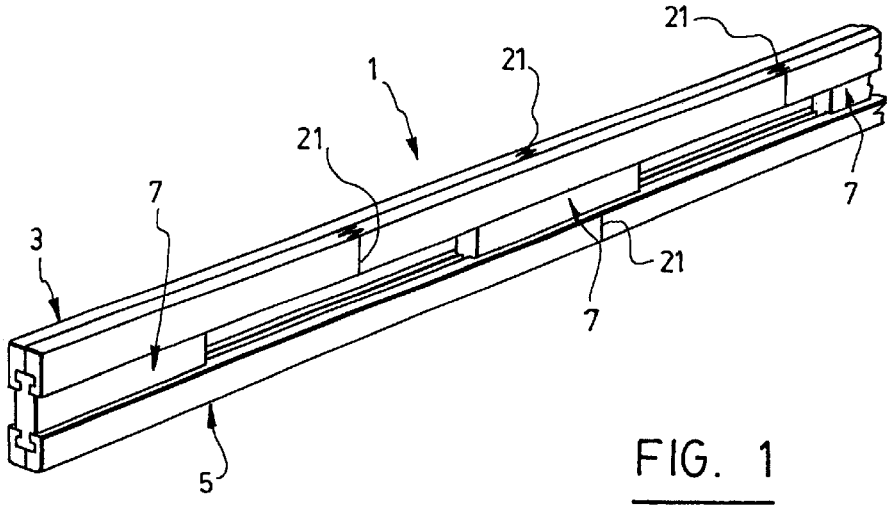
FIG. 1 is a perspective view of a I-shaped wooden beam according to a first preferred embodiment of the invention.
Figure 2:
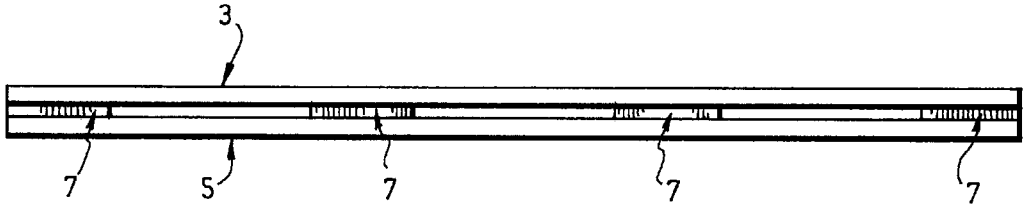
FIG. 2 is a side elevational view of the beam shown in FIG. 1.
Figure 3:
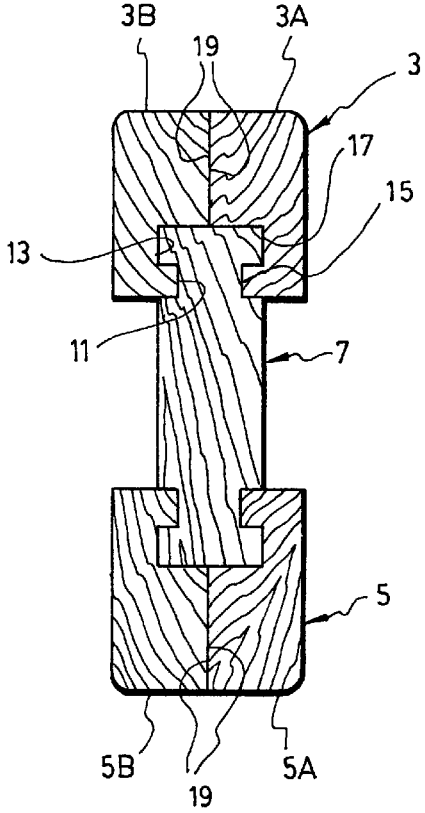
FIG. 3 is an end elevational view of the beam shown in FIGS. 1 and 2.

The I-shaped wooden beam 1 according to the first preferred embodiment of the invention as shown in FIGS. 1 to 3 comprises two elongated chords 3,5 extending in parallel relationship. It also comprises a plurality of rectangular blocks 7 extending between the chords. The blocks 7 act as joining members. They are regularly spaced apart along the length of the beam 1 and have opposite ends rigidly connected to the chords 3,5 so as to form a unitary structure of I-shape.

As aforesaid, this basic structure is known per se. However, in accordance with the invention, this structure is improved in that, as is better shown in FIG. 3, each of the chords 3,5 is made of two pieces of wood 3*a*, 3*b* and 5*a*, 5*b* which have adjacent surfaces 19 that are in contact with each other and extend in parallel relationship with respect to the joining blocks 7 over the corresponding opposite ends thereof. The two pieces of wood 3*a*, 3*b* and 5*a*, 5*b* also have tongues 11 and grooves 13 positioned close to their adjacent surfaces 19 and sized to match with opposite tongues 15 and grooves 17 made on the corresponding opposite ends of the joining blocks 7. Of course, the pieces 3*a*, 3*b* and 5*a*, 5*b* are rigidly connected to each other and to the joining blocks 7 so as to form the requested unitary structure of I-shape.

In the preferred embodiment shown in FIGS. 1 to 3, each opposite end of each joining block 7 has opposite flat faces with opposite notches made therein. The notches define the grooves 15 of this opposite end whereas the remaining portion of the flat faces adjacent these notches define the tongues 17 of this opposite end. As is shown in FIGS. 1 to 3 as well as in FIGS. 6 and 7, each of the pieces of wood 3*a*, 3*b* and 5*a*, 5*b* is rectangular in shape and comprises one side having one edge with a recess made therein. This recess is shaped to define the tongue 11 and groove 13 of the piece. The remaining portion of the one side of the piece that is adjacent to this recess, defines the adjacent surface 19 of the piece that is in contact with the adjacent surface of the adjacent piece.

Figure 4:
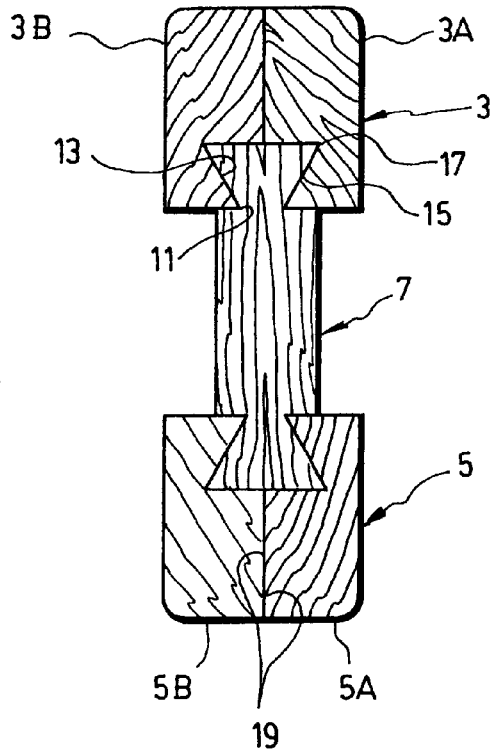
FIG. 4 is an end elevational view of a first variant of the beam shown in FIGS. 1 to 3.
Figure 5:
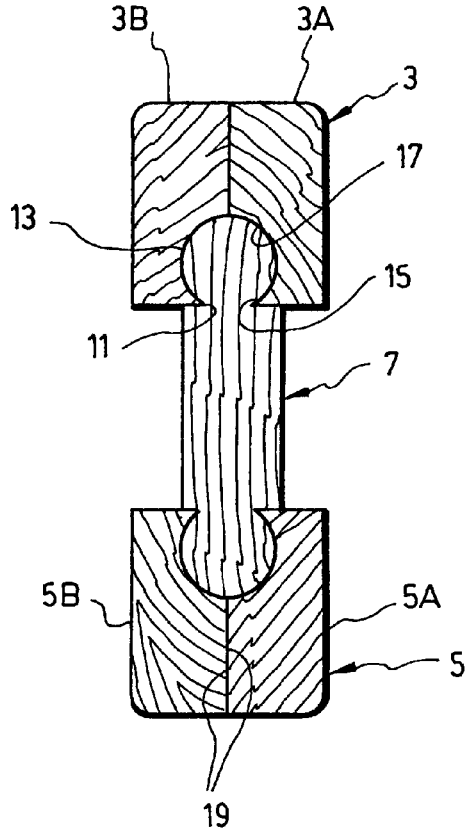
FIG. 5 is an end elevational view of a second variant of the beam shown in FIGS. 1 to 3.
Figure 6:
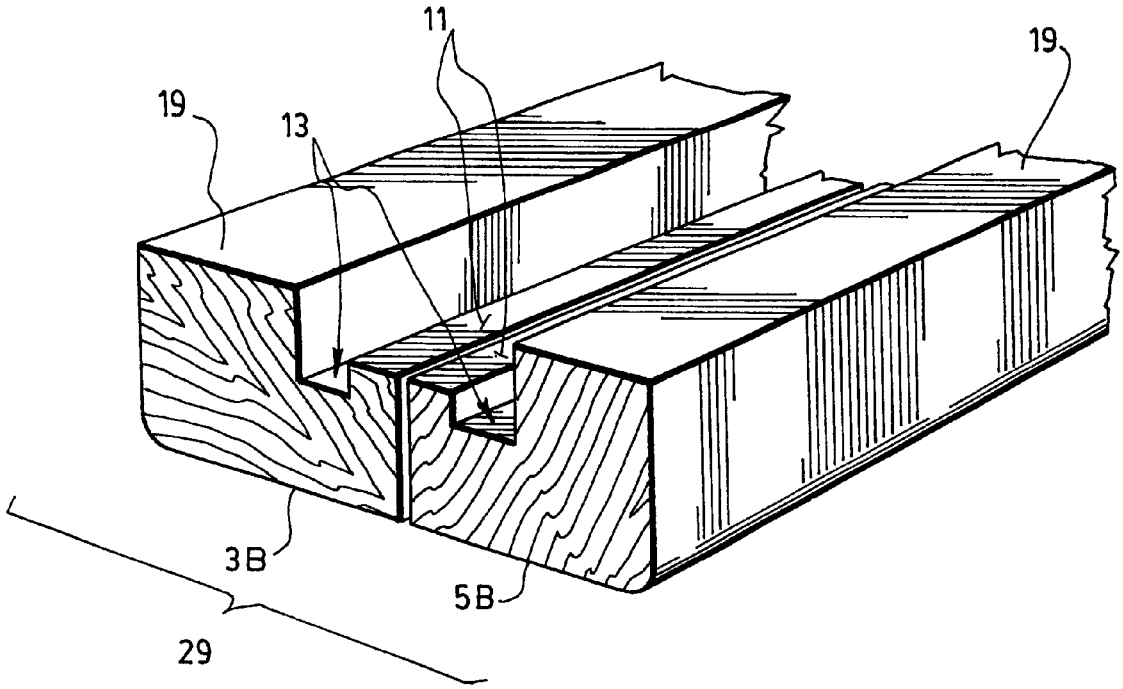
FIG. 6 is a perspective view of a lumber from which two pieces have been cut to make the chords of the beam shown in FIGS. 1 to 3.
Figure 7:
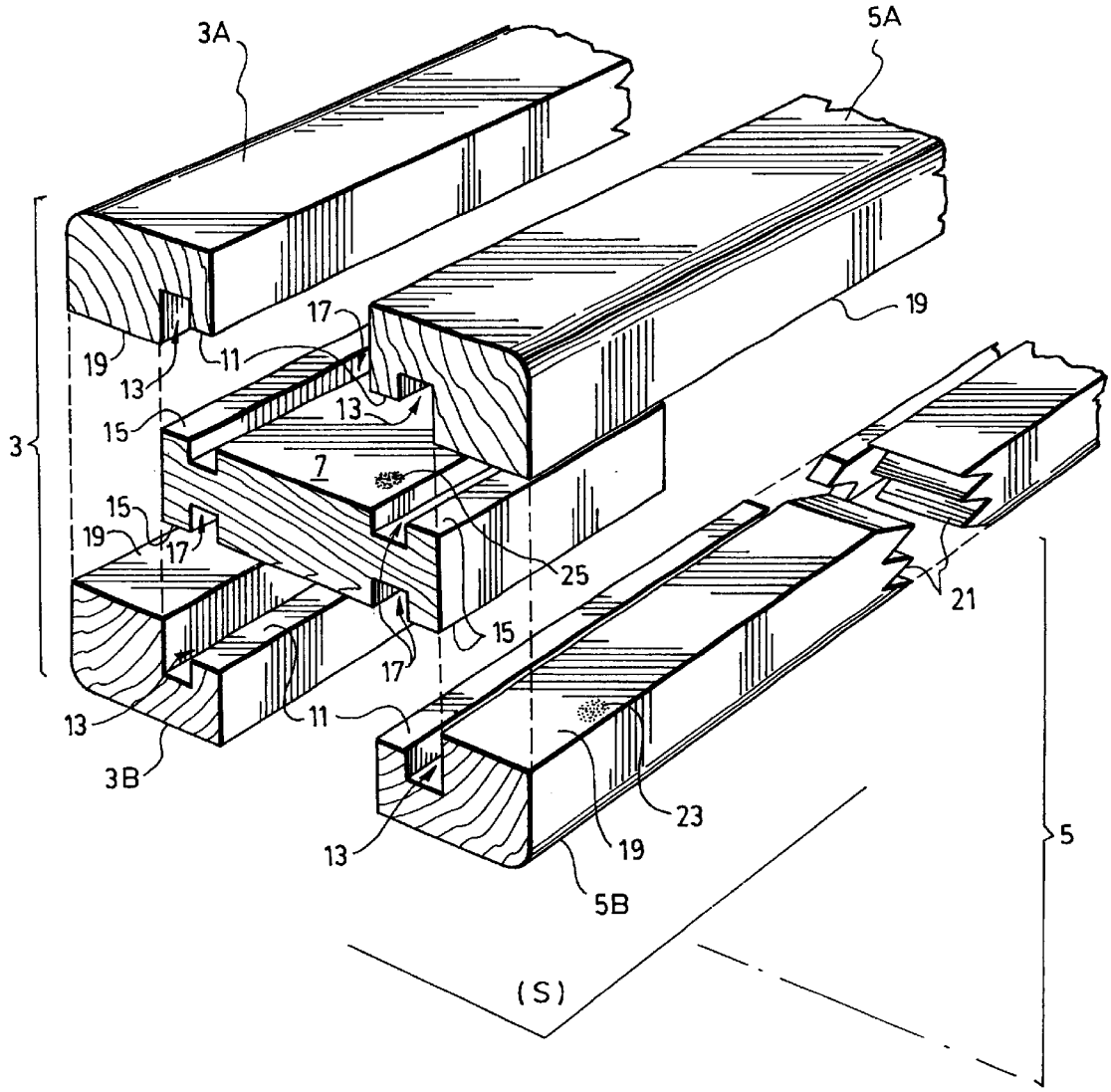
FIG. 7 is an exploded perspective view of the beam shown in FIGS. 1 to 3, explaining the way it can be assembled.

As is also shown in FIGS. 1 to 3 as well as in FIGS. 6 and 7, the tongues 11 and 15 and grooves 13 and 17 made in the pieces 3,5 and the opposite ends of the joining blocks 7 are preferably rectangular in shape. They could however be of other shapes. Thus, for example, in accordance with a first variant shown in FIG. 4, they could be triangular in shape. In accordance with a second variant shown in FIG. 5, they could be round-shaped. As a matter of fact, there could be of any shape provided that they fit into each other and provide proper connection between the chords 3,5 and the blocks 7.

Also, in all the Figures, the tongue 11 and groove 15 of each piece 3*a* or 5*a* (and the corresponding groove and tongue of the opposite end of the blocks) have been shown as having the same shape and size as the tongue 11 and groove 15 of the adjacent piece 3*b* or 5*b*. Such is actually preferred but not essential. Indeed, the tongues and grooves on one side of the I-shaped beam could be of different shape and/or size as those on the opposite side of the same beam.

Similarly, in all the Figures, the adjacent surfaces 19 of the pieces 3*a*, 3*b* and 5*a*, 5*b* have been shown as extending in a same plane extending vertically and centrally with respect to the beam. Once again, such is preferred but not essential. Indeed, the adjacent surfaces of the two pieces forming one chord could extend in a plane different from the one in which could extend the adjacent surfaces of the pieces forming the other chord, and these surfaces could also extend at an angle with respect to the axis of the blocks 7.

Figure 8:
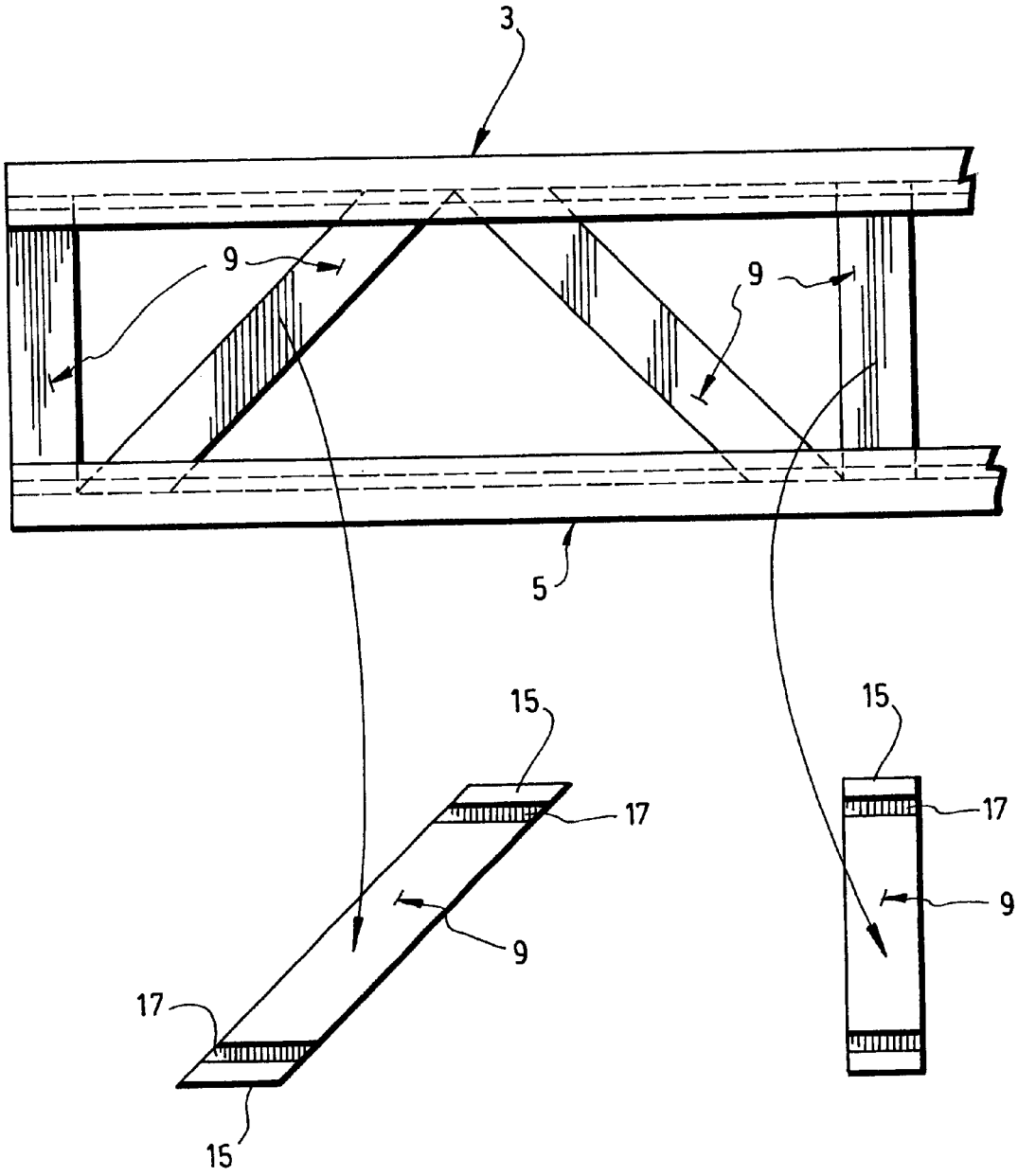
FIG. 8 is an exploded side elevational view of a I-shaped wooden beam according to a second preferred embodiment of the invention.

Instead of spaced apart blocks 7 of rectangular shape as shown in FIGS. 1 to 7, use can be made of struts 9 as joining members extending between the chords 3 and 5. Such is shown in FIG. 8. Of course, the struts 9 must have tongues 15 and grooves 17 at their opposite ends to allow their connection to the chords 3 and 5. These struts 9 can extend perpendicularly or at an angle with respect to the chords. They can also extend at an angle with respect to each other. They may further have their opposite ends in adjacent position and be positioned in such a manner as to give to the joining member a zigzag configuration. Such is well known in the art and needs not be further described.

Instead of using blocks 7 or struts 9, use could also be made of an elongated web (or "board" of wood or plywood) or "oriented straight board" as joining member. Such web would extend over the full length of the beam and would of course also have tongues and grooves on its opposite edges. Once again, such is well known and needs not be further described.

Preferably, the pieces and the blocks, struts or web may be connected to each other with a glue. They could however be connected to each other by other means, such as nails or screws.

When the I-shaped beam is long, it can be made of a plurality of pieces 3*a*, 3*b* and 5*a*, 5*b* having adjacent ends 21 of finger scarf configuration that are rigidly connected to each other preferably by gluing (see FIGS. 1 and 7). Once again, this is well known and need not be explained in greater detail, except to mention that the connections between the pieces extending on one side of a given chord (like, for example, those numbered 5*b*) should be positioned in such a manner as not to be parallel or close to the connections between the other pieces of the same chord (viz. those numbered 5*a*). Such a offset positioning of the connections between the ends 21 of both sets of pieces (see FIG. 1 ) makes the resulting beam as strong and resistant as a beam having chords made of pieces each extending all over its length.

The I-shaped beam 1 disclosed hereinabove can be manufactured as shown in FIG. 7, by:

(a) positioning the pieces of wood 3*b,* 5*b* that extend on a same side of both chords, in a spaced apart, parallel relationship onto a flat surface(s);

(b) applying a layer of glue 23 onto all the surfaces of the tongues 11, grooves 13 and surfaces 19 of the pieces 3*b,* 5*b;*

(c) positioning and pressing the blocks 7 (or struts 9 or web) onto the pieces 3*b,* 5*b* onto which the glue was applied into step (b) to cause the tongues 15 and grooves 17 made on the bottom side of the opposite ends of blocks 7 to snap and fit into the tongues 11 and grooves 13 of the spaced apart pieces 3*b,* 5*b;*

(d) applying another layer of glue 25 onto the other tongues 15 and grooves 17 made on the upper side of the opposite ends of the block 7; and (e) positioning and pressing the other pieces of wood 3*a,* 3*b* of the chords to cause their tongues 11 and grooves 13 to snap and fit into the other grooves 15 and tongues 17 of the block 7, and the surfaces 17 of these other pieces 3*a,* 3*b* to come into contact and be glued to the adjacent surfaces of the pieces 5*a,* 5*b.*

As can be appreciated, this process of manufacture is very single to carry out and have numerous other advantages.

First of all, "large" chords 3,5 can be prepared from "small" pieces 3*a,* 3*b* and 5*a,* 5*b.*

Secondly, the pieces 3*a,* 3*b* and 5*a,* 5*b* are easy to manufacture. As a matter of fact, as shown in FIG. 6, each pair of pieces, like, for example, those numbered 3*b* and 5*b,* can be obtained from a log 29 by making therein a large groove to form the tongues 15, then making deeper grooves on both sides of the large groove to form the grooves 13 and finally cutting the piece of wood 21 into two parts to form the requested pieces 3*b* and 5*b.*

Thirdly, the chords 3,5 and blocks 7 or web 9 are easy to assemble.

Fourthly, when assembled and glued, the pieces and the corresponding blocks or web form a very strong beam.

Last of all, since each of the members 3 and 5 is not made of the same piece of wood but of two separate pieces glued to each other, they are much less subject to warping over the time and/or in the presence of humidity.

In use, the I-shaped beam 1 shown in FIGS. 1 to 3 may, for example, have a total height of 3½". Its chords 3,5 may each have a height of 1½" and a width of 1½". Its blocks may have a total height of 1¾" with tongues and grooves each having a length of 1⅛" and a depth of 7/16". The set of pieces 3*a,* 5*a* or 3*b,* 5*b* may be cut from logs having a cross-section of 2⅜"×¾". The I-shaped beam having such dimensions is usually called 2"×4" I-shaped beam in the trade. It is worth noting that instead of having its chords made of two 2"×1" logs, the beam 1 has its chords made of pieces cut from two 3"×1" logs.

The length of the pieces 3*a,* 3*b* and 5*a,* 5*b* may of course vary. In practice, they can be 8" long and the blocks 7 may be spaced apart at a distance preferably varying from 12" to 24".

Of course, the beam and/or its elements could have other dimension without departing from the scope of the invention.

What is claimed is:

1. In a wooden beam comprising two elongated chords extending in parallel relationship and at least one joining member extending between the chords, said at least one joining member having opposite ends rigidly connected to the chords to form a unitary structure of I-shape, the improvement wherein each of the chords is made of two pieces of wood having adjacent surfaces that are in contact and extend in parallel relationship with respect to the at least one joining member over the corresponding opposite end thereof, said two pieces of wood also having tongues and grooves positioned close to their adjacent surfaces and sized to match with opposite tongues and grooves made on the corresponding opposite end of said at least one joining member, said pieces of wood being rigidly connected to each other and to said at least one joining member so as to form said unitary structure of I-shape.

2. The improved wooden beam of claim 1 wherein:

each opposite end of the at least one joining member has opposite flat faces with opposite notches made therein, said notches defining the grooves of said opposite end, the flat faces adjacent said notches defining the tongues of said opposite end; and each of the pieces of wood is rectangular in shape and comprise one side having one edge with a recess made therein, said recess being shaped to define the tongue and groove of the piece, the one side of said piece adjacent said recess defining the adjacent surface of the piece that is in contact with the adjacent surface of the adjacent piece.

3. The improved wooden beam of claim 2, wherein the tongues and grooves made in the pieces and the opposite ends of the at least one joining member are rectangular in shape.

4. The improved wooden beam of claim 2, wherein the tongues and grooves made in the pieces and the opposite ends of the at least one joining member are triangular in shape.

5. The improved wooden beam of claim 2, wherein said at least one joining member consists of a web having opposite edges that form the opposite ends of said at least one joining member.

6. The improved wooden beam of claim 2, wherein said at least one joining member consists of a plurality of struts having opposite ends that form the opposite ends of said at least one joining member.

7. The improved wooden beam of claim 6, wherein the struts have their opposite ends in adjacent position and altogether give to said at least one joining member a zigzag configuration.

8. The improved wooden beam of claim 7, wherein the struts have their opposite ends in adjacent position and altogether give to said at least one joining member a zigzag configuration.

9. The improved wooden beam of claim 2, wherein the pieces of wood and the at least one joining member are rigidly connected to each other with a glue.

10. A process for manufacturing an improved wooden beam as defined in claim 9, comprising the steps of:

(a) positioning the pieces of wood that extend on a same side of both chords, in a spaced apart, parallel relationship onto a flat surface;

(b) applying a layer of glue onto the tongues, grooves and surfaces of the pieces positioned in step (a);

(c) positioning and pressing the at least one joining member onto the pieces onto which the glue was applied in step (b) to cause the tongues and grooves made on one side of the opposite ends of said at least one joining member to snap and fit into the tongues and grooves of the spaced apart pieces;

(d) applying a layer of the glue onto the other tongues and grooves made on the other sides of the at least one joining member; and (e) positioning and pressing the other pieces of wood of the chords to cause their tongues and grooves to snap and fit into the other grooves and tongues of the at least one joining member, and the surfaces of said other pieces to come into contact and be glued to the adjacent surfaces of the pieces positioned in step (a).

11. The improved wooden beam of claim 1, wherein said at least one joining member consists of a web having opposite edges that form the opposite ends of said at least one joining member.

12. The improved wooden bean of claim 1, wherein said at least one joining member consists of a plurality of struts having opposite ends that form the opposite ends of said at least one joining member.

13. The improved wooden beam of claim 12, wherein the struts extend at an angle with respect to each other.

14. The improved wooden beam of claim 12, wherein the struts have their opposite ends in adjacent position and altogether give to said at least one joining member a zigzag configuration.

15. The improved wooden beam of claim 1, wherein the pieces of wood and the at least one joining member are rigidly connected to each other with a glue.

* * * * *